US010403457B2

(12) United States Patent
Bahr et al.

(10) Patent No.: US 10,403,457 B2
(45) Date of Patent: Sep. 3, 2019

(54) ACTUATING ELEMENT FOR A SWITCH AND DEVICE UTILIZE THE SAME

(71) Applicant: JOHNSON ELECTRIC INTERNATIONAL AG, Murten (CH)

(72) Inventors: Joachim Bahr, Oldenbutg (DE); Jörg Gaßmann, Dresden (DE); Wassim Hayek, Wermelskirchen (DE); Bernhard Jaworek, Hagen (DE); Martin Tomala, Wuppertal (DE); Andreas Wiencek, Castrop (DE)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 0 days.

(21) Appl. No.: 15/820,987

(22) Filed: Nov. 22, 2017

(65) Prior Publication Data

US 2018/0144889 A1 May 24, 2018

(30) Foreign Application Priority Data

Nov. 22, 2016 (DE) ..... 10 2016 122 422

(51) Int. Cl.

| | |
|---|---|
| ***H01H 3/16*** | (2006.01) |
| ***H01H 25/00*** | (2006.01) |
| ***H01H 13/18*** | (2006.01) |
| *H01H 13/14* | (2006.01) |
| *H01H 9/02* | (2006.01) |

(52) U.S. Cl.

CPC ..... *H01H 25/008* (2013.01); *H01H 13/18* (2013.01); *H01H 3/166* (2013.01); *H01H 9/02* (2013.01); *H01H 13/14* (2013.01); *H01H 2221/064* (2013.01)

(58) Field of Classification Search

CPC ..... H01H 25/008; H01H 9/02; H01H 13/14; H01H 13/18; H01H 3/166; H01H 2221/064

USPC ..... 200/573

See application file for complete search history.

(56) References Cited

U.S. PATENT DOCUMENTS

| | | | | |
|---|---|---|---|---|
| 3,883,705 A * | 5/1975 | Sebastian | H01H 23/12 | 200/275 |
| 4,092,504 A * | 5/1978 | Kotaka | H01H 11/0056 | 200/16 D |
| 4,673,778 A * | 6/1987 | Lewandowski | H01H 11/00 | 200/284 |

* cited by examiner

*Primary Examiner* — Anthony R Jimenez

(74) *Attorney, Agent, or Firm* — Muncy, Geissler, Olds & Lowe, P.C.

(57) ABSTRACT

An actuating element for a switch includes a U-shaped actuating section. The actuating section includes two different arms with different lengths. The long arm is configured to transfer force to the push-button of the switch and includes a bracket portion at the free end of the long arm for supporting actuating element. The short arm is configured for the force input and is aligned obliquely to the long arm.

13 Claims, 4 Drawing Sheets

ACTUATING ELEMENT FOR A SWITCH AND DEVICE UTILIZE THE SAME

CROSS REFERENCE TO RELATED APPLICATIONS

This non-provisional patent application claims priority under 35 U.S.C. § 119(a) from Patent Application No. 10 2016 122 422.7 filed in Germany on Nov. 22, 2016.

TECHNICAL FIELD

The present disclosure relates to an actuating element for a switch which is switchable by a button; in particular to a device utilize the actuating element. The actuating element is located in the device between the switch and an action member for transferring the force/movement of the action member to the switch.

BACKGROUND

The switching devices with additional actuating element are already known. These additional actuating elements allow the use of a switch adaptation to different conditions of the device, in particular to different actuating forces and switching paths. In addition to adaptation of several long switching paths and various high actuating forces, there is a problem with some devices that the switch always be mis-loaded by unfavorable transverse forces.

DETAILED DESCRIPTION OF THE EMBODIMENTS

Figure 1:
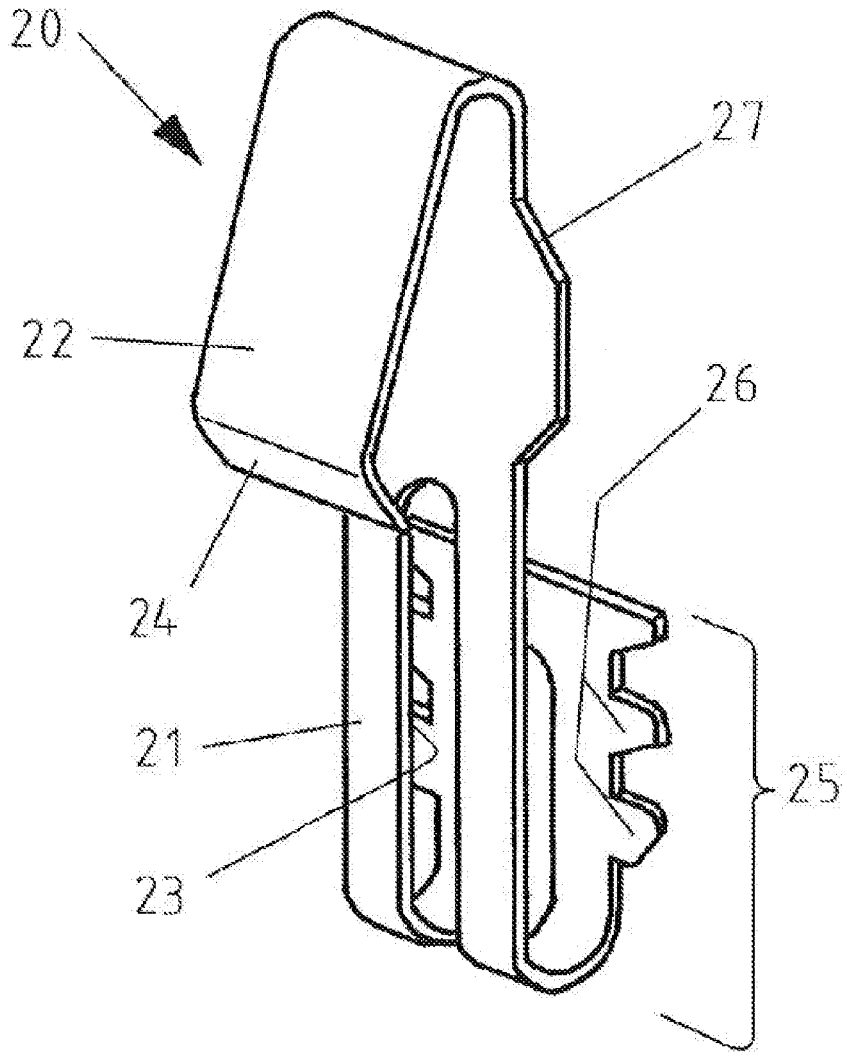
FIG. 1 is a perspective view of an actuating element with S-shaped according to the invention.

Hereinafter technical solutions in embodiments of the present disclosure are described clearly and completely in conjunction with the drawings in embodiments of the present disclosure. Apparently, the described embodiments are only some rather than all of the embodiments of the present disclosure. Any other embodiments obtained based on the embodiments of the present disclosure by those skilled in the art without any creative work fall within the scope of protection of the present disclosure. It is understood that, the drawings are only intended to provide reference and illustration, and not to limit the present disclosure. The connections in the drawings are only intended for the clearance of description, and not to limit the type of connections.

It should be noted that, if a component is described to be "connected" to another component, it may be connected to another component directly, or there may be an intervening component simultaneously. All the technical and scientific terms in the present disclosure have the same definitions as the general understanding of those skilled in the art, unless otherwise defined. Herein the terms in the present disclosure are only intended to describe embodiments, and not to limit the present disclosure.

Figure 3:
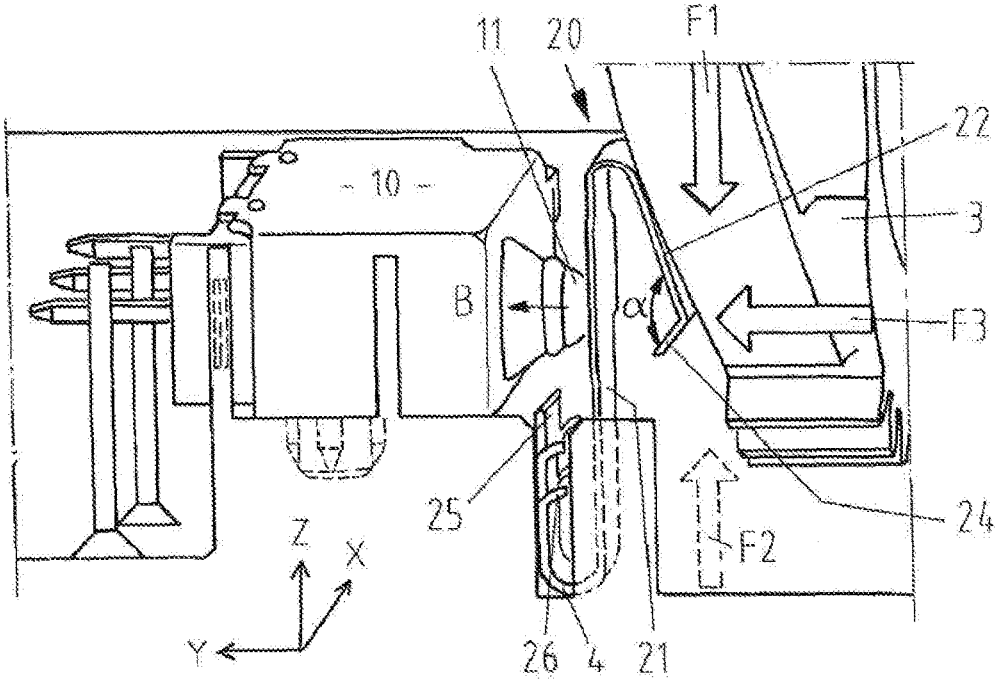
FIG. 3 is a perspective view of the arrangement of FIG. 2 additionally with an action member.

The actuating element 20 is shown in FIG. 1 according to one embodiment of the present disclosure. In at least one embodiment, the actuating element 20 is arranged between an action member 3 and a switch 10 (as shown in FIG. 3), wherein the action member 3 is moveable and then exerts a force on the switch 10 through the actuating element 20 based on the movement. In at least one embodiment, the switch 10 is a microswitch, and the actuating element 20 is work as a spring.

Figure 2:
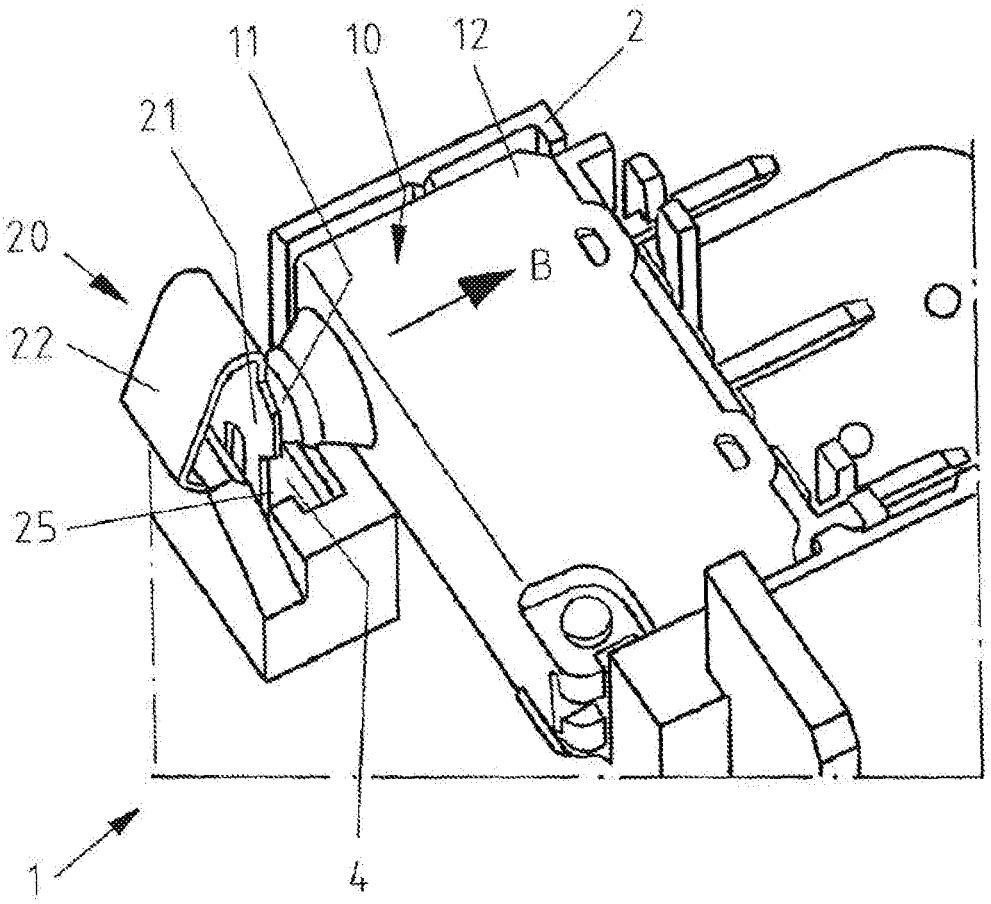
FIG. 2 is a perspective view of the actuating element of FIG. 1 which installed in a device.

The actuating element 20 is shown as an S-shaped shape. The actuating element 20 comprises an actuating section and a bracket portion 25. The actuating section is formed as a U-shaped section and comprises two arms 21, 22. The long arm 21 merges into the bracket portion 25 which serves to support the actuating element 20. For the mounting of the actuating element 20, transverse detents 26 are provided on the bracket portion 25, so that the bracket portion 25 may be inserted in a corresponding receptacle, for example, in a receptacle 4 of the housing 2 of a device as shown in FIG. 2, for fixation. This bracket portion 25 and the short arm 22 are respectively bent on the opposite sides of the long arm 21. As a consequence of S-shape, the bracket portion 25 may also lead to a reset of the actuating element after a force as a result. In addition, in at least one embodiment, a longitudinal slot opening 23 is provided in the long arm 21, which ensures a stiffening of the S-shaped actuating element 20. The longitudinal slot opening 23 preferably extends from the middle of the long arm 21 to its free end.

The actuating element 20 is used for transmitting a force from the action member 3 to a push-button 11 of the switch 10. Specifically, the force is activated by a movement of the action member 3, and transmitted via the actuating element 20 to the switch 10. This force triggers a switching operation of the switch 10. Preferably, the long arm 21 of the actuating element 20 is used for transmitting the force to the push-button 11 of the switch 10. As shown in FIG. 2, the long arm 21 bears against the push-button 11 of the switch 10 and, upon application of force, can release the push-button 11 along its actuating direction B, into a housing 12 of the switch 10, press to trigger a switch contact therefore.

An external force acts on the short arm 22 of the actuating element 20, that is, the force is applied on the short arm 22. The short arm 22 is, as best seen in FIG. 3, aligned obliquely to the long arm 21 in at least one embodiment. By this orientation, it is possible that the action member 3 exerts a force F1 on this short arm 22. If the action member 3 impinges on the short leg 22, then the short arm 22 is pressed in the direction face to the long arm 21, and the push-button 11 is triggered therefore. In the present embodiment of FIG. 3, the action member 3 exerts the above-described force F1 laterally on the short arm 22 as well as a force F3 on the arm from above.

In at least one embodiment, the short arm 22 comprises a deflection 24 at the free end of the short arm 22. A rounded obtuse angle of a is formed between the short arm 22 and the deflection 24. The deflection 24 is aligned so that a force F2 can also act on the micro switch from other side as shown in FIG. 3. Possible forces F1, F2, F3 can be triggered by a linear movement of the action member 3, or also by a rotational movement of the action member 3, and can be absorbed by the additional actuating element 20 (spring) without loading on the switch 10 directly.

In contrast to fixing an actuating element to a switch, the above-mentioned actuating element 20 and its free arrangement in a device 1 allow the force to be loaded from different directions. As shown in FIG. 2, the switch 10 is shown with a box-shaped switch housing 12. The push-button 11 protrudes out from the top of this switch 10. If the additional actuating element 20 is fastened to the switch 10, the box-shaped switch housing 12 has the advantage that the actuating element 20 can extend along the upper side of the switch housing 12. In FIG. 3, a coordinate system is shown. The upper side of the switch 10 thus extends in the X direction, and the actuating direction B of the push-button 11 takes place in the Y direction.

In the case of well-known switches, an actuating element 20 is attached on the switch housing 12 of the switch 10 and extends nearly in the X direction or extends at an acute angle to the X direction. Thus, only forces can be inputted, which act from the direction X or Y. An inputting of force from the Z direction is not possible by the switch 10 equipped with an actuating element 20, since the action member 3 then impinges laterally on the actuating element 20. By a separate arrangement of the new actuating element 20, however, can also be aligned in the housing 2 of the device 1 so that the long arm 21 is aligned in the Z direction and thus can absorb forces F1 and F2, which act in the Z direction, as shown in FIG. 3.

In at least one embodiment, a corresponding receptacle 4 for this bracket portion 25 is preferably provided in the housing 2 of the device 1. It is also possible to connect the actuating element to the housing via another connection, e.g. an adhesive, screw, rivet or other connection to attach.

Figure 4:
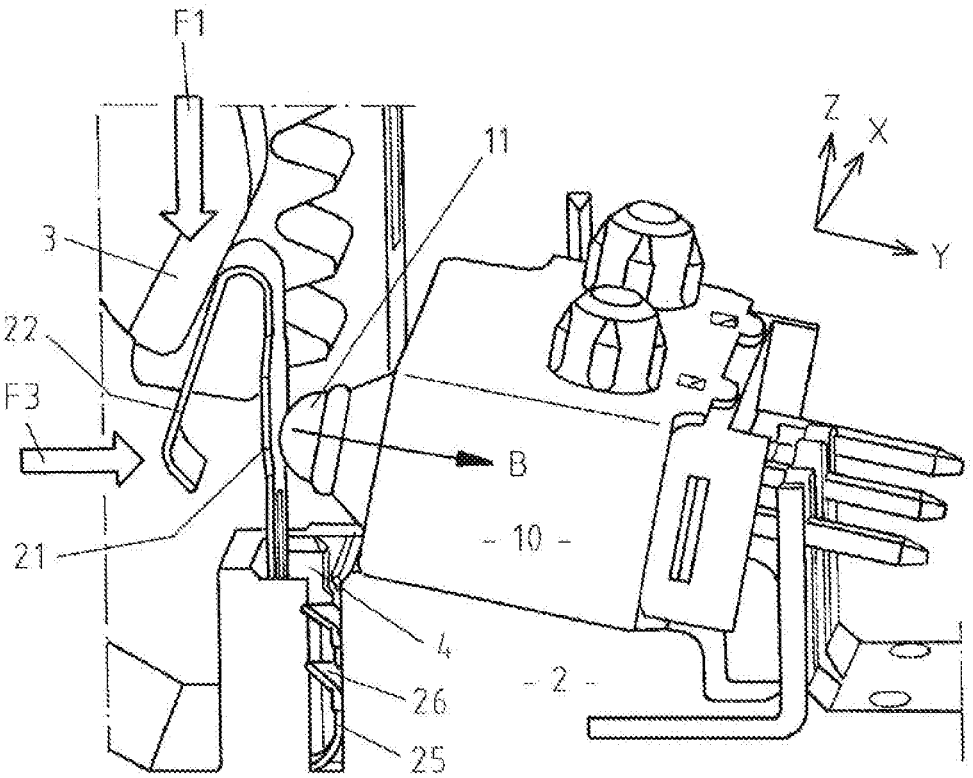
FIG. 4 is perspective view of a further arrangement of the actuating element according to the invention The following implementations are used for the description of the present disclosure in conjunction with above FIG.s.

FIG. 4 shows the detail of another electrical device. The separate additional actuating element 20 is inserted in a receptacle 4 of the housing 2 of the electrical device 1. A similar switch 10 is used as shown in FIG. 3. The new drawn coordinate system is aligned with respect to the position of switch 10. Specifically, the top of the switch 10 is extended along the X direction. The actuating direction B of the push-button 11 extends along the Y direction. The additional actuating element 20 is arranged in the housing 2 of the electrical device 1, that the long arm 21 rests on the push-button 11. In this case, however, the long arm 21 does not extend in the Z-direction, but forms an acute angle with the Z-direction. In this application, the forces F1 and F3 act from different directions on this actuating element 20, by the action member 3, act on the short arm 22. Wherein the force F1 acts almost along the Z direction. Meanwhile, such forces could be absorbed by a separately fastened actuating element from the switch 10 without loaded by lateral forces.

The new actuating element 20 can be positioned through a separate arrangement in the housing 2 of an electrical device 1 between the switch 10 and the action member 3. The forces acting from any direction with respect to the switch 10 by the action member 3 on the push-button 11 of the switch 10 can be transmitted. micro In at least one embodiment, the actuating element 20 is formed of sheet metal. But it is also possible other leaf spring material, such as plastic.

The object of the present invention is to provide an actuating element 20 which can make the switch 10 applicable to variable different environments. The device in present invention has a compact design. The action member does not directly contact the micro switch, so as to protect the switch from overload or run over.

Furthermore, an excess force can be absorbed by the turn of the short arm and the oblique orientation of the leg, which increases the life of the switch. When a force is applied, both a linear movement from different directions as well as a force, which is triggered by a rotational movement, act on the actuating element and are transmitted to the push-button of the switch.

Furthermore, the advantageous S-shaped shape allows a much more compact design than, for example, a straight actuator with the same spring characteristics.

Furthermore, the bend of the short leg can be designed so that it touches the long leg or that it touches the long leg from a certain deflection. As a result, the spring properties can be influenced accordingly.

Described above are preferable embodiments of the present disclosure, which are not intended to limit the present disclosure. All the modifications, equivalent replacements and improvements in the scope of the spirit and principles of the present disclosure are in the protection scope of the present disclosure.

The invention claimed is:

1. An actuating element for a switch, the actuating element comprising:

a U-shaped actuating section, comprising two different arms with different lengths;

wherein a long arm is configured to transfer force to a push-button of the switch and comprises a bracket portion at a free end of the long arm for supporting the actuating element, and wherein a short arm comprises a main body being of a straight shape extended from the long arm, the short arm is configured for a force input and is aligned obliquely to the long arm.

2. The actuating element according to claim 1, wherein the short arm comprises a deflection facing the long arm at a free end of the short arm, the free end of the short arm not touching the long arm in a rest position of the actuating element.

3. The actuating element according to claim 1, wherein the bracket portion and the short arm are respectively bent on opposite sides of the long arm and an S-shaped shape is formed by the bracket portion, the long arm, and the short arm.

4. The actuating element according to claim 1, wherein transverse detents are provided on the bracket portion for fixing the actuating element.

5. The actuating element according to claim 1, wherein a longitudinal slot opening is provided in the long arm which extends from the middle of the long arm to its free end.

6. The actuating element according to claim 1, wherein the actuating element is formed of sheet metal or plastic.

7. The actuating element according to claim 2, wherein a smoothly obtuse angle is formed by the deflection and the short atm.

8. A device, comprising:

a switch, a push-button protruding from a housing of the switch and configured to trigger the switch;

an actuating element which is spring-formed; and an action member which is moveable and exerts a force on the push-button of the switch through the actuating element based on a movement;

wherein the actuating element is disposed separately from the switch in a device housing and is sandwiched between the push-button and action member.

9. The device according to claim 8, wherein the switch is a microswitch.

10. The device according to claim 8, wherein when the top surface of the switch extends in an X direction, an actuation direction of the push-button extends in a Y direction, and the actuator is disposed in the device housing, the long arm of the actuating element moves in the X direction, the Y Direction, a Z direction, or, at an angle from an above direction, respectively.

11. The device according to claim 8, wherein the actuating element comprises:

a U-shaped actuating section, comprising two different arms with different lengths;

wherein a long arm is configured to transfer force to the push-button of the switch and comprises a bracket portion at a free end of the long arm for supporting the actuating element, and wherein a short arm is configured for a force input and is aligned obliquely to the long atm.

12. The device according to claim 8, wherein a receptacle is disposed on the device housing and is configured to mount the actuating element.

13. The device according to claim 12, wherein the receptacle is configured to receive the bracket portion of the actuating element.

* * * * *